US012545977B2

(12) United States Patent
Lilja et al.

(10) Patent No.: US 12,545,977 B2
(45) Date of Patent: Feb. 10, 2026

(54) METHOD OF TREATING A CEMENTED CARBIDE MINING INSERT

(71) Applicant: SANDVIK MINING AND CONSTRUCTION TOOLS AB, Sandviken (SE)

(72) Inventors: Mirjam Lilja, Stockholm (SE); Jose Luis Garcia, Stockholm (SE); Andreas Blomqvist, Stockholm (SE); Ioannis Arvanitidis, Stockholm (SE); Erik Holmstrom, Sandviken (SE)

(73) Assignee: Sandvik Mining and Construction Tools AB, Sandviken (SE)

( * ) Notice: Subject to any disclaimer, the term of this patent is extended or adjusted under 35 U.S.C. 154(b) by 525 days.

(21) Appl. No.: 17/924,394

(22) PCT Filed: May 12, 2021

(86) PCT No.: PCT/EP2021/062685
§ 371 (c)(1),
(2) Date: Nov. 10, 2022

(87) PCT Pub. No.: WO2021/228974
PCT Pub. Date: Nov. 18, 2021

(65) Prior Publication Data

US 2023/0184110 A1 Jun. 15, 2023

(30) Foreign Application Priority Data

May 14, 2020 (EP) ..... 20174546

(51) Int. Cl.
*C22C 1/051* (2023.01)
*B22F 3/24* (2006.01)
(Continued)

(52) U.S. Cl.
CPC ..... *C22C 1/051* (2013.01); *B22F 3/24* (2013.01); *C21D 9/22* (2013.01); *C22C 29/067* (2013.01); *C22C 29/08* (2013.01); *E21C 35/1835* (2020.05)

(58) Field of Classification Search
CPC ... E21C 35/1835; C22C 1/051; C22C 29/067; C22C 29/08; B22F 2998/10;
(Continued)

(56) References Cited

U.S. PATENT DOCUMENTS 4,869,329 A * 9/1989 Kar ..... B23P 15/28 175/57
5,679,445 A * 10/1997 Massa ..... E21B 10/006 175/379
(Continued)

FOREIGN PATENT DOCUMENTS

CN 1480543 A 3/2004
CN 107635700 A 1/2018
(Continued)

OTHER PUBLICATIONS

Keown, Eugene Michel. "The effect of compressive residual stresses on the properties of tumbled-processed cemented carbide." PhD diss., University of Birmingham, 2017. (Year: 2017).*

*Primary Examiner* — Alexandra M Moore
(74) *Attorney, Agent, or Firm* — Corinne R. Gorski

(57) ABSTRACT

A method of redistributing the binder phase of a cemented carbide mining insert having a WC hard-phase component, optionally one or more further hard-phase components and a binder includes the steps of providing a green cemented carbide mining insert; applying at least one binder puller selected from a metal oxide or a metal carbonate to only at least one local area of the surface of the green cemented carbide insert; sintering the green carbide mining insert to form a sintered cemented carbide insert; and subjecting the
(Continued)

sintered cemented carbide insert to dry tumbling process executed at an elevated temperature of or above 100° C., preferably at a temperature of or above 200° C., more preferably at a temperature of between 200° C. and 450° C.

8 Claims, 6 Drawing Sheets

(51) Int. Cl.

| | |
|---|---|
| ***C21D 9/22*** | (2006.01) |
| ***C22C 29/06*** | (2006.01) |
| ***C22C 29/08*** | (2006.01) |
| ***E21C 35/183*** | (2006.01) |

(58) Field of Classification Search
CPC .. B22F 2999/00; B22F 3/24; B22F 2005/001; C21D 1/06; C21D 9/22
See application file for complete search history.

(56) References Cited

U.S. PATENT DOCUMENTS

| | | | | |
|---|---|---|---|---|
| 7,188,993 | B1 * | 3/2007 | Howe | B06B 1/161 366/128 |
| 7,258,833 | B2 | 8/2007 | Rainey et al. | |
| 8,657,894 | B2 * | 2/2014 | Pearce | C22C 47/14 51/307 |
| 8,720,613 | B2 * | 5/2014 | Carlsson | B24B 31/00 175/426 |
| 2004/0009088 | A1 | 1/2004 | Glatzle et al. | |
| 2010/0075122 | A1 * | 3/2010 | Reese | C21D 7/06 428/408 |
| 2012/0144753 | A1 | 6/2012 | Ukuno et al. | |
| 2019/0358707 | A1 | 11/2019 | Garcia et al. | |

FOREIGN PATENT DOCUMENTS

| | | | | |
|---|---|---|---|---|
| CN | 109790076 | A | 5/2019 | |
| EP | 2638992 | A1 | 9/2013 | |
| EP | 3653743 | A1 | 5/2020 | |
| JP | H1150182 | A | 2/1999 | |
| JP | 2009172697 | A | 8/2009 | |
| WO | WO-9707251 | A1 * | 2/1997 | C23C 26/00 |
| WO | 2005056854 | A1 | 6/2005 | |
| WO | 2010056191 | A1 | 5/2010 | |
| WO | 2018060125 | A1 | 4/2018 | |
| WO | 2018099959 | A1 | 6/2018 | |

* cited by examiner

METHOD OF TREATING A CEMENTED CARBIDE MINING INSERT

RELATED APPLICATION DATA

This application is a § 371 National Stage Application of PCT International Application No. PCT/EP2021/062685 filed May 12, 2021 claiming priority to EP 20174546.0 filed May 14, 2020.

TECHNICAL FIELD

The present invention relates to a method of redistributing the binder within a cemented carbide mining insert and then subjecting said cemented carbide mining insert post sintering to a surface hardening process at an elevated temperature, a cemented carbide mining insert with a compressive strength produced from said method and the use thereof.

BACKGROUND

Cemented carbide has a unique combination of high elastic modulus, high hardness, high compressive strength, high wear and abrasion resistance with a good level of toughness. Therefore, cemented carbide is commonly used in products such as mining tools. Cemented carbide mining inserts are commonly treated with an edge deburring and surface hardening process post sintering, such as tumbling, and centreless grinding. The surface hardening process introduces compressive stress into the mining inserts. The presence of the compressive stresses improves the fatigue resistance and fracture toughness of the mining insert. Consequently, the threshold energy necessary to fracture the mining insert is higher and so there is a reduced likelihood of chipping, cracking and/or fracture of the component. Therefore, it is desirable to increase the level of compressive stress introduced into the mining insert to increase the lifetime of the insert.

For maximised performance of cemented carbide mining inserts, a combination of these properties is desired and there are different demands on the material in different parts of the product. For example, in inserts for rock drilling and mineral cutting, it is desirable to have a tougher interior to minimize the risk of failure and a harder exterior to optimise wear resistance.

WO 2010/056191 discloses a method of forming a cemented carbide body comprising a hard phase and a binder phase, wherein at least one part of the intermediate surface zone has lower average binder content than a part further into the body.

High energy tumbling (HET) methods such as those disclosed in U.S. Pat. No. 7,258,833B2 provide a way to increase the level of compressive stresses introduced, however it is desirable to be able to improve this process further by providing a method that can introduce even higher levels of the compressive stresses into the mining inserts without damaging them.

It is an object of the present invention to provide a method of making cemented carbide inserts having optimised hardness gradients and high levels of compressive stresses so that they last longer and have improved operative performance. It is a further objective that the method could be applied to non-symmetrical cemented carbide mining inserts and/or starting from a standard carbide powder which is stoichiometrically balanced with respect to carbon content or has a high carbon content to enhance the binder pulling effect.

Definitions

By "cemented carbide" is herein meant a material that comprises at least 50 wt % WC, possibly other hard constituents common in the art of making cemented carbides and a metallic binder phase preferably selected from one or more of Fe, Co and Ni.

The term "bulk" is herein meant the cemented carbide of the innermost part (centre) of the rock drill insert and for this disclosure is the zone having the lowest hardness.

The term "green" refers to a cemented carbide mining insert produced by milling the hard phase component(s) and the binder together and then pressing the milled powder to form a compact cemented carbide mining insert, which has not yet been sintered.

The term "binder puller" refers to a substance which when applied to the surface of the cemented carbide mining insert will cause the binder to migrate towards that surface during the sintering step, i.e. the binder is pulled in the direction towards the surface, where the "binder puller" has been applied. The binder puller works by locally consuming carbon which causes the binder to flow from the areas having normal carbon levels to the local area where the carbon level has been depleted. The binder puller could also act as a WC grain growth inhibitor that also leads to binder migration towards the applied surfaces with smaller WC grain size than the bulk.

SUMMARY OF INVENTION

According to one aspect of the present invention is a method of redistributing the binder phase of a cemented carbide mining insert comprising a WC hard-phase component, optionally one or more further hard-phase components and a binder comprising the steps of:

a) providing a green cemented carbide mining insert;
b) applying at least one binder puller selected from a metal oxide or a metal carbonate to at least one local area of the surface of the green cemented carbide insert;
c) sintering the green carbide mining insert to form a sintered cemented carbide insert; and
d) subjecting the sintered cemented carbide insert to a dry tumbling process executed at an elevated temperature of or above 100° C., preferably at a temperature of or above 200° C., more preferably at a temperature of between 200° C. and 450° C.

This method allows the binder to be re-distributed in a tailored and most favourable manner to provide optimal functionality to the cemented carbide mining insert in combination with introducing higher levels of compressive stresses into the cemented carbide mining insert. Applying the binder puller, which is a metal compound that during sintering forms an oxide that consumes carbon. The binder puller is selected from a metal oxide or a metal carbonate, and is applied to the surface of the green cemented carbide mining insert in at least one local area, that carbon is locally consumed in this area during sintering which causes the formation of a carbon potential. This will promote the migration of the binder phase from areas having normal or higher levels of carbon to the local area which has a depleted carbon level. If the binder puller compound leads to WC grain refining it will also cause binder migration to the surface where the compound was added. This will therefore form a binder rich region on a local area of the surface of the cemented carbide mining insert. The surface of the green cemented carbide mining insert where the binder puller is applied is referred to as the "oxide/carbonate doped" surface. It is well known that binder rich regions and binder depleted regions will be in tensile stress and compressive stress respectively after sintering. It would normally not be favourable to introduce tensile stresses. However, the inventors have found that after a treatment, such as centrifugal tumbling, high levels of compressive stress, down to at least 1 mm depth below tumbled surface, can be introduced to counteract the tensile stresses present. Therefore, the benefit of applying the binder puller can be gained without the detrimental effect of introducing tensile stresses.

The "at least one local area on the surface of the green cemented carbide mining insert" could be at any position on the surface, for example the tip, the base or the side depending on where the requirement to create an increase in binder content is. The binder puller may be applied to one or more local areas on the surface of the cemented carbide mining insert depending on whether the desired effect is to create a local increase in toughness or wear resistance. Each "local area" may be 0.5-85% of the total surface area of the cemented carbide mining insert, preferably 3-75%.

The sintering temperature is suitably from about 1000° C. to about 1700° C., preferably from about 1200° C. to about 1600° C., most preferably from about 1300° C. to about 1550° C. The sintering time is suitably from about 15 minutes to about 5 hours, preferably from about 30 minutes to about 2 hours.

The higher level of compressive stress in combination with decreased collision defects will improve the fatigue resistance and fracture toughness of the mining insert and consequently increase the lifetime of the insert. Further advantages of this method are that insert geometries, such as those with a sharp bottom radius, which were previously prone to excessive damage to the corners and therefore low yields, can now be tumbled without causing edge damage. This opens the possibility to develop mining insert products with different geometries, which were previously not suitable for tumbling. Increasing the surface treatment process temperature from room temperature up to temperatures such as ~300° C. results in inserts having improved performance properties, such as increased crush strength. Cemented carbide toughness increases with temperature hence tumbling at elevated temperatures collisions do not result in defects such as micro cracks, large cracks or edge chipping.

The cemented carbide responds better to surface hardening process at elevated temperature if there is more binder in the carbide surface zone and/or if the chromium concentration is higher in the surface zone, therefore increasing the strength and toughness of the cemented carbide.

A further aspect of the present application relates to a cemented carbide mining insert comprising one or more hard-phase components and a binder characterized in that the ratio of % fcc phase Co to % hcp phase Co in the top half of the insert is >2, preferably >3, more preferably >4.

The hcp structure is more close-packed than the fcc structure and is the stable structure of pure Co. Co in the hcp phase readily forms twins, which gives it more mechanisms to absorb dislocations without disrupting the crystal lattice. Tumbling at elevated temperatures allows the fcc phase to stabilize and at the same time achieve high compressive strength, consequently more phase transformation can take place during drilling, which increases the lifetime of the insert.

DETAILED DESCRIPTION

Figure 1:
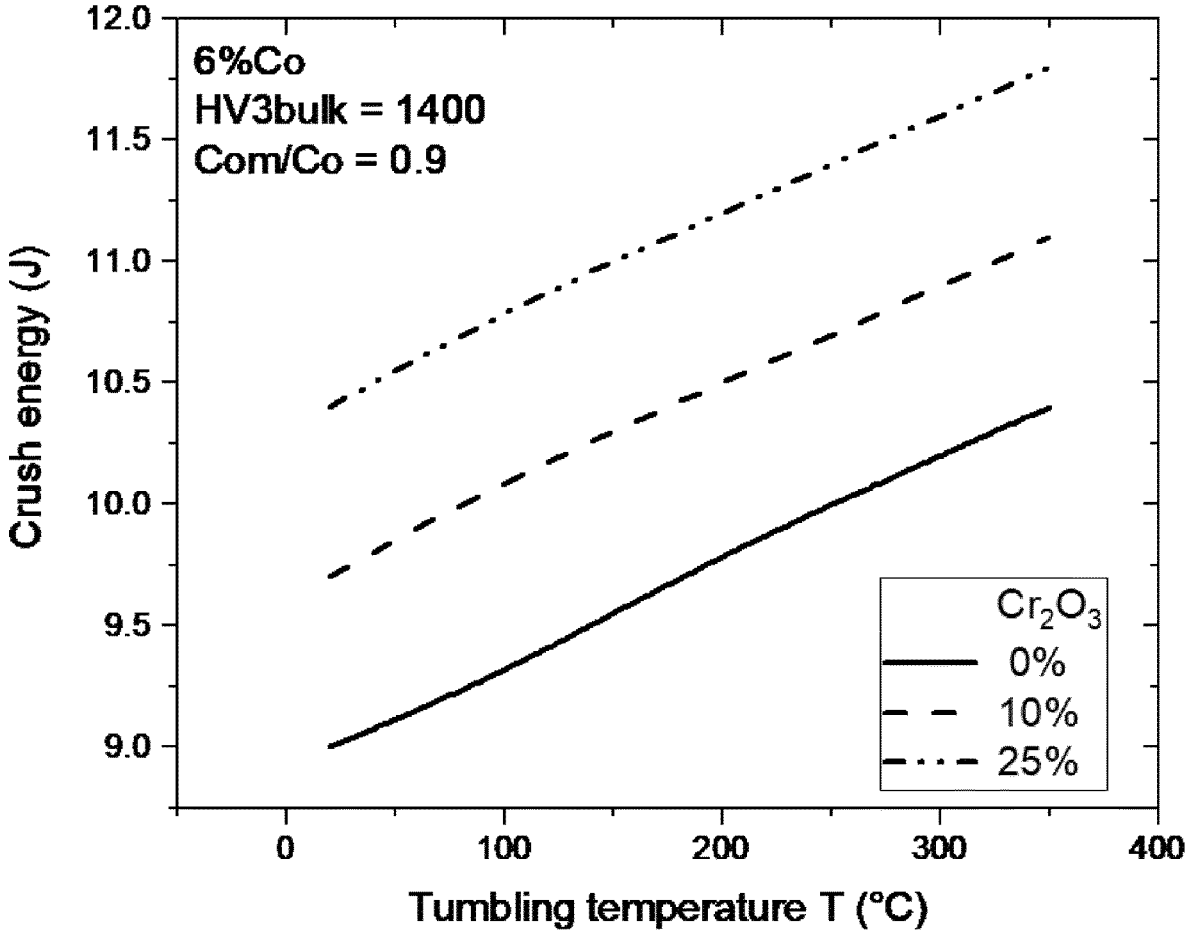
FIG. 1: Plot of crush energy.

In one embodiment of the method, the cemented carbide mining insert contains a hard phase comprising at least 80 wt % WC, preferably at least 90 wt %.

The metallic binder of the cemented carbide can comprise other elements that are dissolved in the metallic binder during sintering, such as W and C originating from the WC. Depending on what other types of hard constituents that are present, also other elements can be dissolved in the binder.

In one embodiment the cemented carbide comprises hard constituents in a metallic binder phase, and wherein the metallic binder phase content in the cemented carbide is 4 to 30 wt %, preferably 5 to 15 wt %.

The binder phase content needs to be high enough to provide a tough behaviour of the mining insert. The metallic binder phase content is preferably not higher than 30 wt %, preferably not higher than 15 wt %. A too high content of binder phase reduces the hardness and wear resistance of the mining insert. The metallic binder phase content is preferably greater than 4 wt %, more preferably greater than 6 wt %.

In one embodiment metallic binder phase comprises at least 80 wt % of one or more metallic elements selected from Co, Ni and Fe.

Preferably Co and/or Ni, most preferably Co, even more preferably between 3 to 20 wt % Co. Optionally, the binder is a nickel chromium or nickel aluminium alloy. The carbide mining insert may optionally also comprise a grain refiner compound in an amount of ≤20 wt % of the binder content. The grain refiner compound is suitably selected from the group of carbides, mixed carbides, carbonitrides or nitrides of vanadium, chromium, tantalum and niobium. With the remainder of the carbide mining insert being made up of the one or more hard-phase components.

The one or more further hard-phase components may be selected from TaC, TiC, TIN, TiCN, NbC, CrC. The binder phase may be selected from Co, Ni, Fe or a mixture thereof, preferably Co and/or Ni, most preferable Co. The carbide mining insert has a suitable binder content of from about 4 to about 30 wt %, preferably from about 5 to about 15 wt %. The carbide mining insert may optionally also comprise a grain refiner compound in an amount of ≤20 wt % of the binder content. The grain refiner compound is suitably selected from the group of carbides, mixed carbides, carbonitrides or nitrides of vanadium, chromium, tantalum and niobium. With the remainder of the carbide mining insert being made up of the one or more hard-phase components.

In one embodiment of the method, the binder puller, being a metal oxide or metal carbonate is selected from $Cr_2O_3$, MnO, $MnO_2$, $MoO_2$, Fe-oxides, NiO, $NbO_2$, $V_2O_3$, $MnCO_3$, $FeCO_3$, $CoCO_3$, $NiCO_3$, $CuCO_3$ or $Ag_2CO_3$. It would also be possible to alternatively apply a metal to the surface of the green cemented carbide mining insert which upon heating, during the sintering step, would form an oxide. The selection of the metal oxide or metal carbonate will influence the properties of the cemented carbide post sintering e.g. deformation hardening, heat resistance and/or corrosion resistance and the selection can be made to be best suited to the required application. Metal carbonates would be selected if the equivalent metal oxide is toxic and the metal carbonate is not. In this method, there is a high degree of freedom as to where the binder puller is applied, for example it could be applied in or away from the wear zones of the carbide tool, depending on whether the metal in the oxide or carbonate improves the wear resistance of the cemented carbide or not.

In one embodiment of the method, the binder puller is $Cr_2O_3$. Using $Cr_2O_3$ as the binder puller has the advantage that a chromium alloy rich surface layer will form, which has an enhanced response to a tumbling treatment. Therefore, higher compressive stresses will be introduced, and the wear properties of the cemented carbide mining insert will be improved. The $Cr_3O_2$ contributes towards grain refinement and hence, a reduced grain size is measured on the side of the insert where the $Cr_3O_2$ has been applied.

The metal oxide or metal carbonate is suitably provided onto the surface or surfaces in an amount of from about 0.1 to about 100 mg/cm$^2$, preferably in an amount of from about 1 to about 50 mg/cm$^2$. The starting cemented carbide powder blend should suitably have a carbon balance equivalent to 0.75<Com/% Co<1 or have an excess of carbon that would compensate for the carbon reduction from the application of the oxide or carbonate. Com (%) is equal to $100*4T\pi\sigma_1/4\pi\sigma_0$, where $4\pi\sigma_1$ [$\mu Tm^3$/kg] is the weight specific magnetic saturation of the carbide insert and 4100=201.9 [$\mu Tm^3$/kg] is the weight specific magnetic saturation for pure Co. Com is measured in a Foerster Koerzimat CS.1097 unit.

In one embodiment of the method, the binder puller is applied to the top of the cemented carbide mining insert. In another embodiment of the method, the binder puller is applied to the side of the cemented carbide mining insert. Therefore, the properties of the cemented carbide mining insert can be tailored to be suited to the application. The binder puller is likely chosen to be applied to the position on the surface of the cemented carbide mining insert that is exposed to the highest wear.

In one embodiment, the method of applying the binder puller is selected from pressing, dipping, painting, spraying (air brushing), stamping or 3D printing. Dipping could be done with or without masking. The binder puller may be applied to the surface of green cemented carbide mining insert in the form of liquid dispersions or a slurry. In such as case, the liquid phase is suitably water, an alcohol or a polymer such as polyethylene glycol. The concentration of the slurry is suitably 5-50 wt % of the powder in the liquid phase, such as 10-40 wt %. This range is advantageous so that a sufficient effect of the binder puller is realised. If the powder content is too high, then there may be issues with clogging and lumping within the liquid dispersion or slurry. Alternatively, they could be introduced as a solid substance, for example by adding the powder into the pressing mould in a suitable position. The powder could be mixed with a hard-phase powder, for example a WC-based powder. The binder puller could also be applied to the cemented carbide mining insert in any other suitable way. The compositions and concentration of the slurry and the way it is applied influences the control of the redistribution of the binder and therefore allows the hardness profile of the cemented carbide mining insert to be controlled.

As there is flexibility in where the binder puller is applied, this allows tailoring of the position of the "wear zone", i.e. the position on the surface having the most enhanced combination of strength and wear properties. For example, the wear zone could be on either the top or the side of the insert depending where the interaction between the cemented carbide mining insert and rock being drilled is the highest. This will vary depending on the application it is being used for and the position of the cemented carbide mining insert on the rock drill bit. Further, as Cr alloying improves wear resistance, the doping can be applied to the most region of the insert that most exposed to the rock during drilling.

Cemented carbide mining inserts are subjected to high compressive loading. Consequently, surface cracking caused by small cracks growing to a critical size through repeated intermittent high loading is a common cause of insert failure. It is known that introducing compressive stress into the surface of the insert can reduce this problem as the presence of the compressive stress can prevent crack growth and wear of the material. Known methods of introducing compressive stress into surfaces of a cemented carbide mining insert include shot peening, vibration tumbling and centrifugal tumbling. These methods are all based on mechanical impact or deformation of the outer surface of the body and will increase the lifetime of the cemented carbide mining inserts.

A surface hardening treatment is defined as any treatment that introduces compressive stresses into the material through physical impacts, that results in deformation hardening at and below the surface, for example tumbling or shot peening. The surface hardening treatment is done post sintering and grinding. It has unexpectedly been found, that treating a mining insert with a surface hardening treatment at elevated temperatures decreases or even eliminates the carbide to carbide collision damages in terms of chipping and micro fracturing and therefore improving product lifetime. The surface hardening process of the present invention is performed at an elevated temperature, and this temperature is herein defined as the temperature of the mining insert at the start of the surface hardening process. The upper limit for the temperature, where the surface hardening process is performed, is preferably below the sintering temperature, more preferably below 900° C. The temperature of the mining insert is measured by any method suitable for measuring temperature, such as an infrared temperature measurement.

In one embodiment of the present invention the mining insert is subjected to a surface hardening treatment at a temperature of between 100-600° C., preferably at a temperature of between 150-500° C., more preferably 200-400° C.

The temperature is measured on the mining insert using any suitable method for measuring temperature. Preferably, an infrared temperature measurement device is used.

In one embodiment the method includes a step of heating the mining inserts and media prior to the surface hardening process and the surface hardening process is performed on heated mining inserts.

The mining insert can be heated in a separate step prior to the surface hardening process step. Several methods can be used to create the elevated temperature of the mining insert, such as induction heating, friction heating, resistance heating, hot air heating, flame heating, pre-heating on a hot surface, in an oven or furnace or using laser heating.

In an alternative embodiment, the mining inserts are kept heated during the surface hardening process. For examples using an induction coil.

The tumbling treatment could be centrifugal or vibrational. A "standard" tumbling process would typically be done using a vibrational tumbler, such as a Reni Cirillo RC 650, where about 30 kg inserts would be tumbled at about 50 Hz for about 40 minutes. An alternative typical "standard" tumbling process would be using a centrifugal tumbler such as the ERBA-120 having a closed lid at the top and has a rotating disc at the bottom. One more method is the centrifugal barrel finishing process. In both centrifugal processes, the rotation causes the inserts to collide with other inserts or with any media added. For "standard" tumbling using a centrifugal tumbler the tumbling operation would typically be run from 120 RPM for at least 20 minutes. The lining of the tumbler may form oxide or metal deposits onto the surface of the inserts.

It may be necessary to modify the lining of the tumbler to be able to withstand the higher elevated temperatures that the process is conducted at.

To introduce higher levels of compressive stresses into the cemented carbide mining insert, a high energy tumbling process may be used. There are many different possible process setups that could be used to introduce HET, including the type of tumbler, the volume of media added (if any), the treatment time and the process set up, e.g. RPM for a centrifugal tumbler etc. Therefore, the most appropriate way to define HET is in terms of "any process set up that introduces a specific degree of deformation hardening in a homogenous cemented carbide mining insert consisting of WC—Co, having a mass of about 20 g". In the present disclosure, HET is defined as a tumbling treatment that would introduce a hardness change, measured using HV3, after tumbling (ΔHV3%) of at least:

$$\Delta HV3\%=9.72-0.00543*HV3_{bulk} \quad \text{(equation 1)}$$

Wherein:

$$\Delta HV3\%=100*(HV3_{0.3\ mm}-HV3_{bulk})/HV3_{bulk} \quad \text{(equation 2)}$$

$HV3_{bulk}$ is an average of at least 30 indentation points measured in the innermost (center) of the cemented carbide mining insert and $HV3_{0.3\ mm}$ is an average of at least 30 indentation points at 0.3 mm below the tumbled surface of the cemented carbide mining insert. This is based on the measurements being made on a cemented carbide mining insert having homogenous properties. By "homogeneous properties" we mean that post sintering the hardness different is no more than 1% from the surface zone to the bulk zone. The tumbling parameters used to achieve the deformation hardening described in equations (1) and (2) on a homogenous cemented carbide mining insert would be applied to cemented carbide bodies having a gradient property.

HET tumbling may typically be performed using an ERBA 120, having a disc size of about 600 mm, run at about 150 RPM if the tumbling operation is either performed without media or with media that is larger in size than the inserts being tumbled, or at about 200 RPM if the media used is smaller in size than the inserts being tumbled; using a Rösler tumbler, having a disc size of about 350 mm, at about 200 RPM if the tumbling operation is either performed without media or with media that is larger in size than the inserts being tumbled, or at about 280 RPM if the media used is smaller in size than the inserts being tumbled. Typically, the parts are tumbled for at least 40-60 minutes.

The effect of the surface hardening treatment at elevated temperatures is enhanced if the process is done in dry conditions. By "dry" conditions it is meant that no liquid is added to the process. Without being found by this theory, it is thought that, if liquid is introduced to the process, it will keep the parts at room temperature. Further, the inclusion of the liquid will reduce the degree of the impact between the parts being tumbling. Liquid prevents the internal friction and collision heat to increase the temperature in the collision points. If no liquid is used, then the temperature at the collision points gets high resulting in a higher toughness of the material subjected to the collision points.

Alternatively, the tumbler could be pressurized to a pressure that prevents water from boiling so that it would be possible to conduct the high temperature tumbling in wet conditions.

The tumbling process could be conducted in the presence or absence of tumbling media depending on the geometry and material composition of the mining inserts being tumbled. If it is decided to add tumbling media, the type and ratio of media to inserts is selected to suit the geometry and material composition of the mining inserts being tumbled.

Optionally, all or part of the heat is generated by friction between the inserts and any media added in the tumbling process.

Optionally, the inserts are further subjected to a second surface hardening process. Preferably, if a second surface hardening process performed at room temperature is done, preferably the second surface hardening process is HET tumbling at room temperature in wet condition.

A further aspect of the present invention relates to a cemented carbide mining insert comprising one or more hard-phase components and a binder characterized in that the ratio of % fcc phase Co to % hcp phase Co in the top half of the insert is >2, preferably greater than 3, more preferably greater than 4. The "% fcc Co" is the percentage of Co in the face centred cubic phase and the "% hcp Co" is the percentage of Co in the hexagonal close packed phase. The percentage of each phase can be measured using EBSD. The increased ratio of % fcc phase Co to % hcp phase Co in the top half of the insert results in inserts having a higher crush strength. For pure Co, hcp is the stable phase and fcc is metastable. Most commonly the dominant phase in cemented carbides is fcc due to the alloying of the carbon and tungsten during sintering. The surface hardening treatment will induce defects in the binder, i.e. stacking faults and dislocations. When the tendency of forming stacking faults increases, it improves the mechanical properties in fcc Co. With increasing strain, the mobility of defects will be limited and fcc to hcp phase transformation will take place in the material. By enabling the fcc Co phase to stabilize this means more fcc to hcp transformation will occur during drilling. Therefore it is advantageous to have a starting material with a higher ratio of fcc to hcp Co. The surface doping causes Co to migrate during sintering towards the doped areas, in this case the drill insert top. The alloying effect of Cr and the grain growth inhibiting effect by Cr should also affect the magnetic coercivity and magnetic proportion. Hence, there is a difference in the magnetic properties between the top and the bottom.

In one embodiment:

$$\frac{-1.5}{1000} < \frac{(Com_B - Com_T)*(Hc_T - Hc_B)}{Com \cdot Hc} < \frac{5.5}{1000}$$

where $Com_T$ is the magnetic percentage proportion in the top half of the insert, $Com_B$ is the magnetic percentage proportion in the bottom half of the insert. $Hc_T$ is the magnetic coercivity in the top half of the inserts and $Hc_B$ is the magnetic coercivity in the bottom half of the insert. Hc and Com are the magnetic coercivity and magnetic percentage proportion respectively of the insert before cutting.

In one embodiment $$1.2 < \frac{\% \ Cr_T}{\% \ Cr_B} < 50$$

where % $Cr_T$ is the weight percent of Cr in the top half of the insert and % $Cr_B$ is the weight percent of Cr in the bottom half of the insert. Higher chromium levels in the tip of the insert will lead to increased wear resistance which will lead to improved drilling performance.

In one embodiment the hardness measured 150 μm below the surface is at least 20 HV3, preferably at least 30 HV3 greater than the hardness measured in the bulk. This hardness profile is optimal for rock drilling inserts as it provides a hard surface and tough bulk.

The hardness of the cemented carbide inserts is measured using Vickers hardness automated measurement. The cemented carbide bodies are sectioned along the longitudinal axis and polished using standard procedures. The sectioning is done with a diamond disc cutter under flowing water. Vickers indentations at a 3 kg load are then distributed over the polished section at the given depths below surface. The hardness of the top surface zone is an average of about 20 indentations (non-doped inserts) or 30 indentations (doped inserts) taken at the given distance 150 μm below the surface under the dome. The hardness of the bottom surface zone is an average of about 18 indentations (non doped inserts) or 24 indentations (doped inserts) taken at the given distance 150 μm below the surface under the bottom.

The hardness measurements are performed using a programmable hardness tester, KB30S by KB Prüftechnik GmbH calibrated against HV1 test blocks issued by Euro Products Calibration Laboratory, UK. Hardness is measured according to ISO EN6507-01.

HV3 measurements were done in the following way:

Scanning the edge of the sample.

Programming the hardness tester to make indentations at specified distances from the edge of the sample.

Indentation with 3 kg load at all programmed co-ordinates.

The computer moves the stage to each co-ordinate, locates the microscope over each indentation, and runs auto adjust light, auto focus and the automatically measures the size of each indentation.

The user inspects all the photos of the indentations for focus and other matters that disturb the result.

In one embodiment there is a first binder concentration minimum (% binder-min), between the doped surface and the bulk, in percentage of the total height of the sintered cemented carbide mining insert, at between 1-50% from the doped surface, preferably between 5-40%. The % binder-min is typically at a depth of 0.5-10 mm, preferably 0.8-7 mm from the first part of the surface.

In one embodiment there is a first chromium concentration maximum at the doped surface.

In one embodiment the concentration of cobalt is higher in the top half of the mining insert compared to the bottom half of the mining insert.

In one embodiment the concentration of chromium is higher in the top half of the mining insert compared to the bottom half of the mining insert.

The chemical concentrations within the cemented carbide mining insert are measured using wavelength dispersive spectroscopy (WDS) along the centreline of a cross sectioned cemented carbide mining insert.

In one embodiment the mining insert is uncoated.

Another aspect of the present disclosure relates to the use of the cemented carbide mining insert as described hereinbefore or hereinafter for rock drilling or oil and gas drilling.

EXAMPLES

Example 1—Starting Materials and Tumbling Conditions

Design of experiments (DOE) was used for planning the experiments where input factors are varied in a systematic way in the factor space in order to understand the response of the process studied. In this case the JMP software by SAS was used. Custom design option in the software was chosen and the factors of binder concentration, carbon balance, doping amount and tumbling temperature were varied. Magnetic coercivity (kA/m) and cobalt magnetic proportion (Com %) were both measured post sintering and grinding and again after tumbling.

TABLE 1

Composition of mining inserts tested.

| | Input factors | | | Magnetic properties after sintering and grinding | | | Magnetic properties after tumbling. |
|---|---|---|---|---|---|---|---|
| Run | % Co* | mg $Cr_2O_3$ per insert | Tumbling temperature (° C.) | Com (%) | Hc (kA/m) | Com/Co | Hc (kA/m) |
| 1 | 6 | 9.45 | 25 | 4.51 | 9.83 | 0.75 | 9.98 |
| 2 | 6 | 0 | 25 | 5.44 | 9.24 | 0.91 | 9.71 |
| 3 | 6 | 19.76 | 25 | 5.60 | 9.24 | 0.93 | 9.89 |
| 4 | 9.5 | 0 | 25 | 7.45 | 6.71 | 0.78 | 7.01 |
| 5 | 9.5 | 16 | 25 | 7.03 | 7.02 | 0.74 | 7.30 |
| 6 | 9.5 | 8.25 | 25 | 9.19 | 4.72 | 0.96 | 5.25 |
| 7 (invention) | 6 | 15.2 | 150 | 4.41 | 9.86 | 0.74 | 9.99 |
| 8 (invention) | 6 | 8.55 | 150 | 5.24 | 9.41 | 0.87 | 9.77 |
| 9 (invention) | 6 | 8.4 | 150 | 5.85 | 8.89 | 0.97 | 9.36 |
| 10 (invention) | 9.5 | 9.15 | 150 | 8.33 | 5.47 | 0.88 | 6.10 |
| 11 | 6 | 0 | 300 | 4.72 | 9.74 | 0.79 | 9.71 |
| 12 (invention) | 6 | 15.4 | 300 | 4.39 | 9.87 | 0.73 | 9.92 |
| 13 (invention) | 6 | 9 | 300 | 5.21 | 9.50 | 0.87 | 9.74 |

TABLE 1-continued

Composition of mining inserts tested.

| Run | Input factors % Co* | mg $Cr_2O_3$ per insert | Tumbling temperature (° C.) | Magnetic properties after sintering and grinding Com (%) | Hc (kA/m) | Com/Co | Magnetic properties after tumbling. Hc (kA/m) |
|---|---|---|---|---|---|---|---|
| 14 (invention) | 9.5 | 9.3 | 300 | 7.18 | 6.93 | 0.76 | 7.07 |
| 15 | 9.5 | 0 | 300 | 9.23 | 4.59 | 0.97 | 4.62 |
| 16 (invention) | 9.5 | 17.68 | 300 | 9.08 | 4.86 | 0.95 | 5.31 |

*Balance of WC.

All cemented carbide inserts were produced using a WC powder grain size measured as FSSS was before milling between 5 and 18 μm. The WC and Co powders were milled in a ball mill in wet conditions, using ethanol, with an addition of 2 wt % polyethylene glycol (PEG 8000) as organic binder (pressing agent) and cemented carbide milling bodies. After milling, the mixture was spray-dried in N2-atmosphere and then uniaxially pressed into GT7S100A mining inserts having a size of about 10 mm in outer diameter (OD) and about 16-20 mm in height with a weight of approximately 17 g each with a spherical dome ("cutting edge") on the top. The inserts were doped by vertically dipping them with the tip downwards to a depth corresponding to half of the cylinder part of the insert or about 11 mm of the total insert height into a slurry comprising $Cr_2O_3$ and PEG300. Three different $Cr_2O_3$ concentrations, 15, 20 and 26%, were used as detailed in table 1. The 15% $Cr_2O_3$ suspension resulted in 8-10 mg $Cr_2O_3$ per insert, the 20% $Cr_2O_3$ suspension resulted in 15-16 mg $Cr_2O_3$ per insert and the 26% $Cr_2O_3$ suspension resulted in 17.5-20 mg $Cr_2O_3$ per insert. The samples were then sintered using Sinter-HIP in 55 bar Ar-pressure at 1410° C. for 1 hour and then ground.

After sintering and grinding, in order to replicate tumbling at an elevated temperature on a lab scale a "hot shaking" method has been used. The hot shaking method uses a commercially available paint shaker of trade mark Corob™ Simple Shake 90 with a maximum load of 40 kg and a maximum shaking frequency of 65 Hz. The "hot shaking" method was conducted at a frequency of 45 Hz. About 800 grams or 50 pieces of inserts and 4.2 kg carbide media (1560 pieces of about 7 mm balls) where placed in a cylindrical steel container with inner diameter of 10 cm and inner height of 12 cm filling it up to ⅔ of the height. The steel cylinder with the mining insert were heated with media in a furnace to an elevated temperature of 150 or 300° C., the mining inserts were held at the target temperature for 120 minutes. After heating, the steel cylinder was transferred straight into the paint shaker and immediately shook for 9 minutes. The transfer time between the furnace until the shaker started was less than 20 seconds. The media was made of the cemented carbide grade H10F having 10 wt % Co, 0.5 wt % Cr and 89.5 wt % WC that results in sintered HV20 of about 1600. The shaking was performed in dry conditions, i.e. no water was added to the shaking at 150 or 300° C. A laser guided infrared thermometer M7 by MIKRON was used for the temperature measurements and the temperature was taken inside the vessel on the inserts. In order to prevent the temperature from rising for the runs 1-6, conducted at 25° C., 100 ml amount of water was added to the batch of inserts and media. For all runs the inserts were left to cool down to room temperature before they were subjected to a final wet centrifugal tumbling operation for 50 minutes at 300 RPM with 50 kg 7 mm H10F tumbling media in a Rösler FKS04 tumbler (post tumbling Hc measurements in table 1 are after both tumbling steps).

Example 2—Edge Damage

It is important that the damage to the edges of the mining inserts is low, preferably none at all, post tumbling in order to have the highest yields. The region most prone to chipping is at the sharp corner between the base and the side of the inserts, where there is typically a radius of about 0.5 mm.

The mining inserts were inspected visually for damages post tumbling and none of the samples surface hardened at 150° C. or 300° C. showed any edge damage, even at the sharpest radius between the base and sides of the insert.

Example 3—Insert Compression Test

The insert compression test method involves compressing a drill bit insert between two plane-parallel hard counter surfaces, at a constant displacement rate, until the failure of the insert. A test fixture based on the ISO 4506:2017 (E) standard "Hardmetals—Compression test" was used, with cemented carbide anvils of hardness exceeding 2000 HV, while the test method itself was adapted to toughness testing of rock drill inserts. The fixture was fitted onto an Instron 5989 test frame.

The loading axis was identical with the axis of rotational symmetry of the inserts. The counter surfaces of the fixture fulfilled the degree of parallelism required in the ISO 4506:2017 (E) standard, i.e. a maximum deviation of 0.5 μm/mm. The tested inserts were loaded at a constant rate of crosshead displacement equal to 0.6 mm/min until failure, while recording the load-displacement curve. The compliance of the test rig and test fixture was subtracted from the measured load-displacement curve before test evaluation. Five inserts were tested per run. The counter surfaces were inspected for damage before each test. Insert failure was defined to take place when the measured load suddenly dropped by at least 1000 N. Subsequent inspection of tested inserts confirmed that this in all cases this coincided with the occurrence of a macroscopically visible crack. The material strength was characterized by means of the total absorbed deformation energy until fracture. The summary fracture energy (Ec), in Joules (J), required to crush the samples is shown in table 2 below:

TABLE 2

| Fracture energy (J) required to crush the samples | |
|---|---|
| Run | Fracture energy Ec (J) |
| 1 | 9.3 |
| 2 | 9.3 |
| 3 | 10.9 |
| 4 | 9.4 |
| 5 | 9.0 |
| 6 | 10.2 |
| 7 | 11.0 |
| 8 | 10.1 |
| 9 | 10.4 |
| 10 | 9.9 |
| 11 | 10.5 |
| 12 | 11.3 |
| 13 | 10.8 |
| 14 | 10.0 |
| 15 | 10.9 |
| 16 | 10.3 |

FIG. 1 is a plot modelled from the DOE results tables 1 and 2 showing the effect of the tumbling temperature and concentration of $Cr_2O_3$ in the dopant on the crush strength for a 6% Co grade with Com/Co=0.9 and a bulk hardness of 1400HV3. It can be seen from FIG. 1 that there is an increase in the crush strength as a result of increasing the tumbling temperature and from increasing the amount (concentration) of the $Cr_2O_3$ slurry used for the doping. The combination of the increased wear resistance due to Cr in the binder and the increased crush strength increases the insert performance.

Example 4—Hardness Measurements

The hardness of the cemented carbide inserts is measured using Vickers hardness automated measurement described hereinabove. The cemented carbide bodies were sectioned along the longitudinal axis and polished using standard procedures. The sectioning is done with a diamond disc cutter under flowing water. Vickers indentations at a 3 kg load are then distributed over the polished section at the given depths below surface. In the case for non doped runs the distance between the indentations is 0.7 mm at depths 0.15 and 0.3 mm, 0.6 mm at depths 0.6 and 1.2 mm and 0.4 mm at depths 2.4 and 4.8 mm. For the doped runs the distance between the indentations is 0.5 mm at depths 0.15, 0.3, 0.8, 1.3, 1.8, 2.3, 2.8, 3.3, 3.8, 4.3 and 4.8 mm.

The hardness of the top surface zone is an average of about 20 indentations for the non-doped inserts or of about 30 indentations for the doped inserts, taken at the given distance 150 μm below the surface under the dome. The hardness of the bottom surface zone is an average of about 18 indentations for the non doped inserts or of about 24 indentations for the doped inserts, taken at the given distance 150 μm below the surface under the bottom.

The hardness of the bulk is an average of about 30 indentations for the non-doped inserts or of about 60 indentations for the doped inserts, the bulk hardness measurements were taken at the innermost distances. Two samples were measured per run. Table 3 shows a summary of the hardness measurements post tumbling.

TABLE 3

| hardness measurements | | | |
|---|---|---|---|
| Run | $HV3_{max}$ 150 μm below the top surface (dome) | $HV3_{max}$ 150 μm above the bottom surface | $HV3_{bulk}$ in middle of the sample (bulk) |
| 1 | 1522 | 1488 | 1401 |
| 2 | 1453 | 1445 | 1388 |
| 3 | 1466 | 1470 | 1379 |
| 4 | 1196 | 1181 | 1136 |
| 5 | 1256 | 1107 | 1137 |
| 6 | 1159 | 1142 | 1103 |
| 7 | 1536 | 1490 | 1399 |
| 8 | 1467 | 1456 | 1388 |
| 9 | 1443 | 1457 | 1389 |
| 10 | 1131 | 1122 | 1108 |
| 11 | 1489 | 1471 | 1415 |
| 12 | 1541 | 1498 | 1400 |
| 13 | 1459 | 1455 | 1400 |
| 14 | 1233 | 1193 | 1142 |
| 15 | 1148 | 1138 | 1101 |
| 16 | 1147 | 1139 | 1101 |

Figure 2:
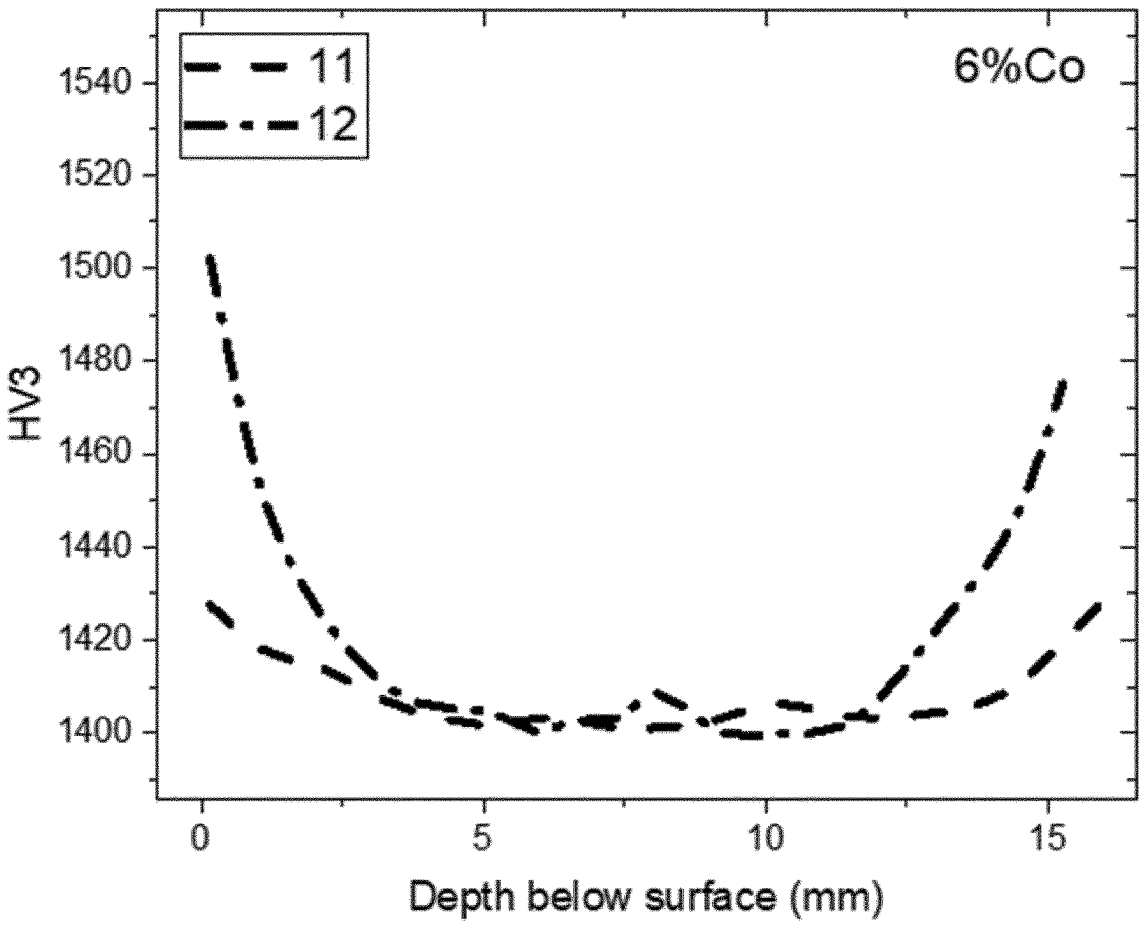
FIG. 2: Hardness profile for runs 11 (comparative) and 12 (invention).
Figure 3:
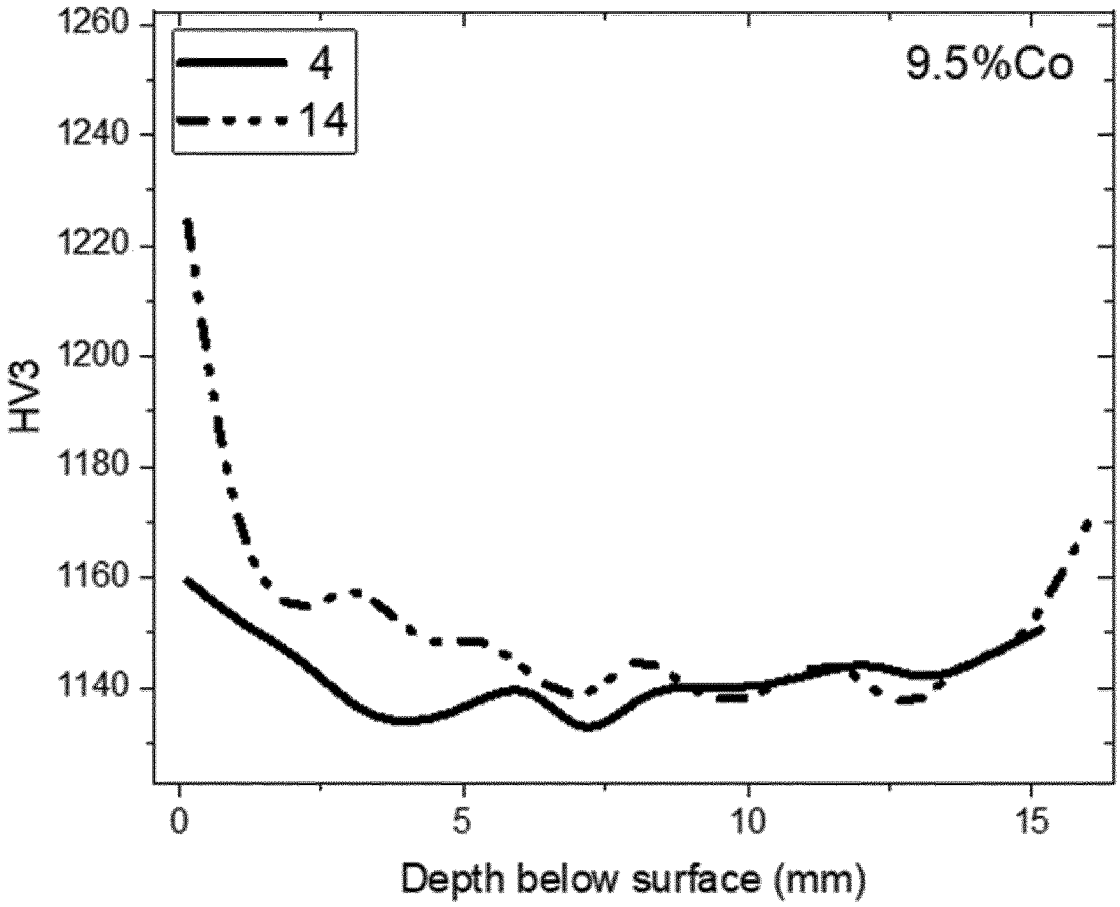
FIG. 3: Hardness profile for runs 4 (comparative) and 14 (invention).

FIG. 2 is the hardness profile from the tip to the base of an insert from run 11 (comparative) and 12 (invention) and FIG. 3 is a hardness profile from an insert from run 4 (comparative) and 14 (invention). The profiles show that there is a higher hardness at the surfaces compared to the bulk and that the tumbling increases the hardness about the same in bottom and the tip when looking at the non doped runs 4 and 11.

Example 5—Chemical Analysis

Figure 4:
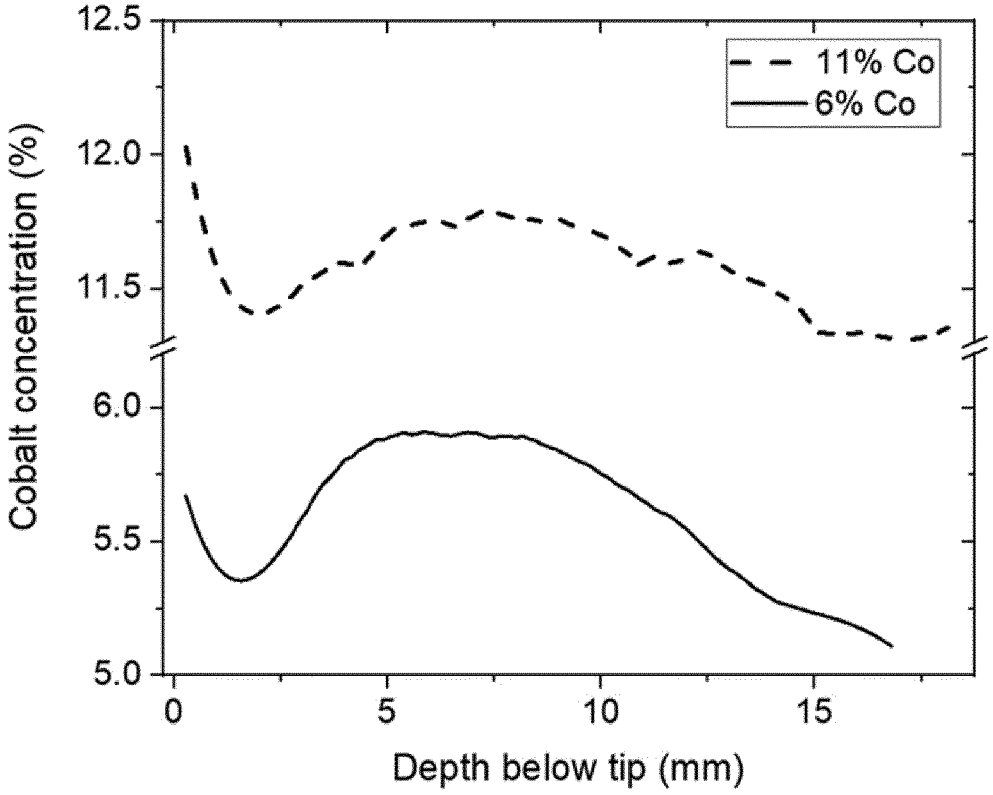
FIG. 4: Plot of cobalt concentration profiles.
Figure 5:
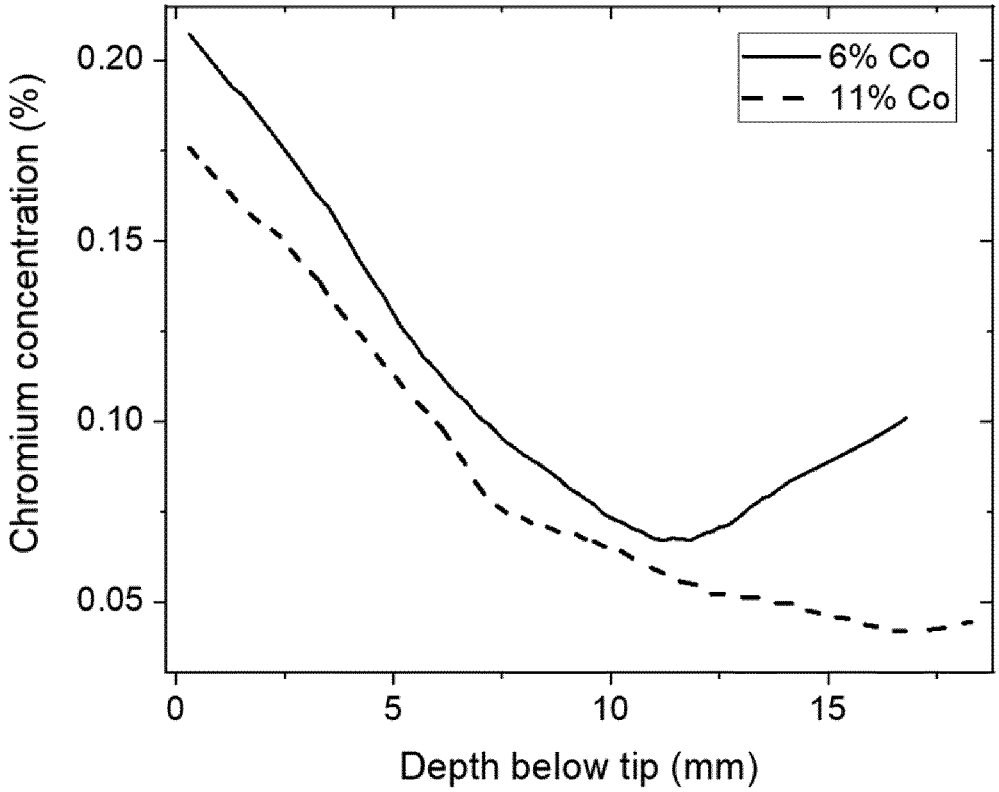
FIG. 5: Plot of chromium concentration profiles.
Figure 6:
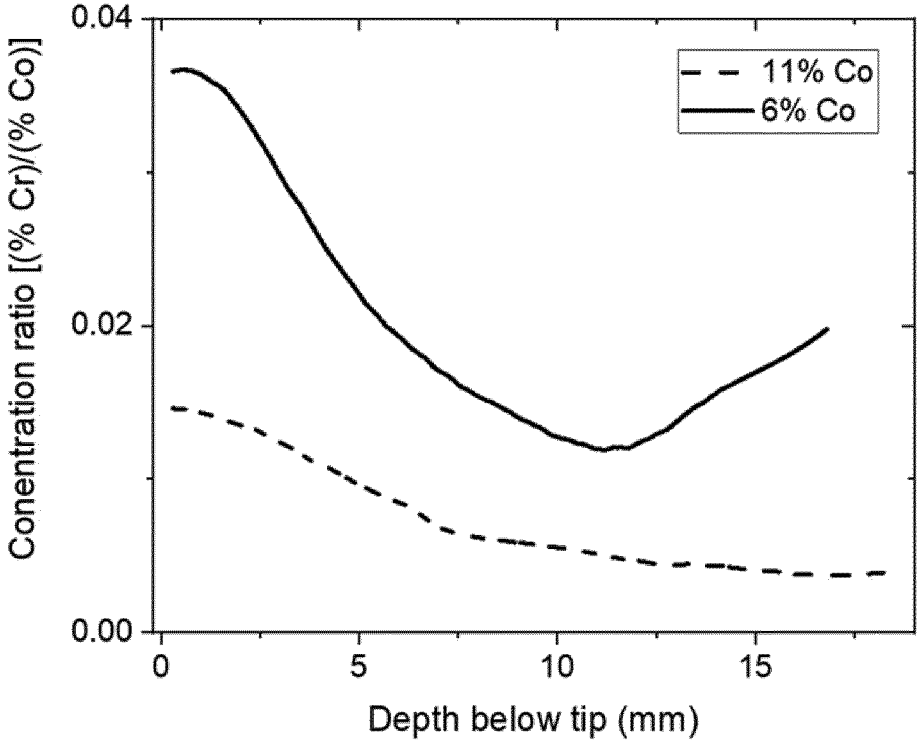
FIG. 6: Plot of Cr/Co concentration ratios.

The chemical gradient of the sample was investigated by means of wavelength dispersive spectroscopy (WDS) analysis using a Jeol JXA-8530F microprobe. Line scans along the centre line were done on cross sections of the sintered materials, prior to tumbling for cemented carbide insert comprising 6 wt % Co and 96 wt % WC and for a cemented carbide comprising 11 wt % Co and 89 wt % Co that were doped by dipping the samples into a slurry comprising 30 wt % $Cr_3O_2$ and 70 wt % PEG300 on its domed surface (corresponding to a concentration of 0.25-0.28 mg/mm$^2$) with about 60% of the total insert length exposed to the oxide slurry. The samples were prepared using a precision cutter, followed by mechanical grinding and polishing. The final step of the sample preparation was carried out by polishing with 1 μm diamond paste on a soft cloth. An acceleration voltage of 15 kV was used to perform line scans with a step size of 100 μm and a probe diameter of 100 μm. Three line scans per sample were carried out and the average is reported. FIG. 4 shows the chemical profile of the cobalt concentration, FIG. 5 shows the chemical profile for the chromium concentration and FIG. 6 shows the chemical profile for Cr/Co for both 6 and 11 wt % Co samples prior to tumbling. The tumbling treatment will not affect the chemical composition and so the same chemical gradient profiles will be present post tumbling.

Chromium concentrations were measured in the top and bottom halves of the inserts using X-ray fluorescence (XRF) using a Malvern Panalytical Axios Max Advanced instrument according to ASTM B 890-07. For the chromium measurement, one insert per run was then orthogonally cut into a top half and a bottom half, with each section having about the same height (±0.5 mm) using a 1 mm diamond disc cutter.

For chromium doped inserts we then express the chromium ratio as:

$$\beta = \frac{\% \ Cr_T}{\% \ Cr_B}$$

wherein the % $Cr_T$ is the percentage of Cr in the top half of the insert and the % $Cr_B$ is the percentage of Cr in the bottom half of the insert.

TABLE 4

Chromium concentration measurements

| | XRF measurement of the samples. | | |
|---|---|---|---|
| Run | % $Cr_T$ (wt %) | % $Cr_B$ (wt %) | β (% $Cr_T$/% $Cr_B$) |
| 1 | 0.05 | 0.03 | 1.7 |
| 2 | <0.01 | <0.01 | Non doped |
| 3 | 0.07 | 0.04 | 1.8 |
| 4 | <0.01 | <0.01 | Non doped |
| 5 | 0.08 | 0.05 | 1.6 |
| 6 | 0.04 | 0.02 | 2.0 |
| 7 | 0.07 | 0.04 | 1.8 |
| 8 | 0.04 | 0.02 | 2.0 |
| 9 | 0.04 | 0.03 | 1.3 |
| 10 | 0.04 | 0.02 | 2.0 |
| 11 | <0.01 | <0.01 | Non doped |
| 12 | 0.07 | 0.04 | 1.8 |
| 13 | 0.04 | 0.02 | 2.0 |
| 14 | 0.04 | 0.02 | 2.0 |
| 15 | <0.01 | <0.01 | Non doped |
| 16 | 0.12 | 0.05 | 2.4 |

Example 6—Magnetic Properties

The magnetic coercivity, (Hc) and magnetic percentage proportion, Com (%) was measured post tumbling. Three inserts per run were then orthogonally cut into a top half and a bottom half, with each section having about the same height (±0.5 mm) using a 1 mm diamond disc cutter. Hc and Com were measured again for each half. $HC_T$ and $Hc_B$ are the measured magnetic coercivity in the top and bottom halves of the inserts respectively. $Com_T$ and $Com_B$ are the magnetic percentage proportion measured for the top and bottom halves respectively. These measurements are recorded in the table below, along with a, which is calculated from the following equation:

$$\alpha = \frac{(Com_B - Com_T) * (Hc_T - Hc_B)}{Com \cdot Hc}$$

TABLE 5

Magnetic measurements post tumbling

| | Uncut inserts | | Top half | | Bottom half | | |
|---|---|---|---|---|---|---|---|
| Run | Hc (kA/m) | Com (%) | $HC_T$ (kA/m) | $Com_T$ (%) | $HC_B$ (kA/m) | $Com_B$ (%) | α × 1000 |
| 1 | 9.967 | 4.484 | 10.17 | 4.337 | 9.999 | 4.618 | 1.07 |
| 2 | 9.725 | 5.426 | 9.833 | 5.432 | 9.842 | 5.424 | 0.00 |
| 3 | 9.828 | 5.643 | 10.17 | 5.654 | 9.808 | 5.639 | −0.10 |
| 4 | 7.016 | 7.434 | 7.150 | 7.466 | 7.159 | 7.431 | 0.01 |
| 5 | 7.333 | 7.010 | 7.595 | 6.691 | 7.388 | 7.317 | 2.53 |
| 6 | 5.296 | 9.164 | 5.556 | 9.157 | 5.345 | 9.157 | 0.00 |
| 7 | 9.991 | 4.400 | 10.17 | 4.192 | 10.01 | 4.557 | 1.33 |
| 8 | 9.752 | 5.212 | 9.893 | 5.232 | 9.902 | 5.210 | 0.00 |
| 9 | 9.321 | 5.827 | 9.605 | 5.886 | 9.313 | 5.791 | −0.51 |

TABLE 5-continued

Magnetic measurements post tumbling

| | Uncut inserts | | Top half | | Bottom half | | |
|---|---|---|---|---|---|---|---|
| Run | Hc (kA/m) | Com (%) | $HC_T$ (kA/m) | $Com_T$ (%) | $HC_B$ (kA/m) | $Com_B$ (%) | α × 1000 |
| 10 | 6.134 | 8.307 | 6.442 | 8.459 | 6.241 | 8.192 | −1.05 |
| 11 | 9.693 | 4.718 | 9.728 | 4.740 | 9.779 | 4.706 | 0.04 |
| 12 | 9.923 | 4.411 | 10.06 | 4.236 | 9.945 | 4.547 | 0.86 |
| 13 | 9.719 | 5.191 | 9.788 | 5.239 | 9.824 | 5.157 | 0.06 |
| 14 | 7.060 | 7.188 | 7.271 | 6.961 | 7.111 | 7.347 | 1.22 |
| 15 | 4.608 | 9.229 | 4.692 | 9.233 | 4.683 | 9.215 | −0.00 |
| 16 | 5.567 | 8.964 | 6.118 | 8.914 | 5.415 | 8.993 | 1.12 |

Example 7—Electron Backscatter Diffraction (EBSD)

EBSD measurements were made on the samples to produce maps of the sample microstructure at selected positions. These maps were evaluated using the crystallographic information to determine the phases.

Measurements were made at a depth of 0.5 mm from the surface, to represent the microstructure at top of the insert, and at 10 mm from the surface of the insert to represent the microstructure in the bulk of the insert. The inserts were prepared for EBSD by mechanical polishing of a plan parallel cross section using a diamond 9 μm slurry down to a diamond size of 1 μm followed by an ion polishing step performed in an Hitachi IM 400 in flat mode. The prepared samples were then mounted onto a sample holder and inserted into the scanning electron microscope (SEM). The samples were tilted 70 degrees with respect to the horizontal plane and towards the EBSD detector. The SEM used for the characterization was a Jeol JSM-7800F, using a 70 μm im objective aperture. The used EBSD detector was an Oxford Instruments Nordlys Detector operated using Oxford Instruments "AZtec" software version 4.3. EBSD data acquisitions were made by applying a focused electron beam on to the polished surfaces and sequentially acquiring EBSD data using a step size of 0.05 μm for an area of 90 μm×90 μm. The SEM settings used were: acceleration Voltage=20 kV; aperture size=70 μm; working distance=15 mm; detector insertion distance=182 mm; Optimize Pattern: binning 4×4; static background on, auto background on; Optimize Solver: optimized TKL model; Number of Bands 8; Hough Resolution 60; Apply refinement on. Reference phases used were:

WC (hexagonal), 41 reflectors, Acta Ctystallogr., [ACCRA9], (1961), vol. 14, pages 200-201.

Co (cubic), 44 reflectors, Z. Angew. Phys., [ZAPHAX], (1967), vol. 23, pages 245-249. Co (hexagonal), 44 reflectors, Fiz. Met. Metalloved, {FMMTAKJ, (1968), vol. 26, pages 140-143.

The EBSD data was collected and analyzed in AZtec 3.4. Noise reduction was performed by removing wild spikes and performing zero solution removal at extrapolation level 3 (low level). Measurements were taken for 2 samples per run. The table below shows the average proportion of fcc Co vs hcp Co measured in the top and bottom halves of the inserts:

TABLE 6

| Average Co phase fractions measured using EBSD | | | | | | | |
|---|---|---|---|---|---|---|---|
| Run | % fcc Co top half | % fcc Co bottom half | % fcc Co top/ % fcc Co bottom | % hcp Co top half | % hcp Co bottom half | fcc/hcp top half | fcc/hcp bottom half |
| 3 | 2.38 | 4.18 | 0.57 | 1.71 | 0.62 | 1.38 | 6.82 |
| 13 (invention) | 5.06 | 4.49 | 1.13 | 0.05 | 0.62 | 92.83 | 7.26 |
| 6 | 5.82 | 11.5 | 0.50 | 4.9 | 0.98 | 1.20 | 11.77 |
| 16 (invention) | 9.52 | 11.22 | 0.84 | 1.71 | 1.53 | 5.74 | 7.49 |

The invention claimed is:

1. A method of redistributing a binder phase of a cemented carbide mining insert having a WC hard-phase component, optionally one or more further hard-phase components and a binder, the method comprising the steps of:

providing a green cemented carbide mining insert;

applying at least one binder puller selected from a metal oxide or a metal carbonate to 0.5 to 85% of the total surface area of the green cemented carbide insert;

sintering the green carbide mining insert to form a sintered cemented carbide insert; and subjecting the sintered cemented carbide insert to a dry tumbling process executed at an elevated temperature between 100° C. to 600° C.

2. The method according to claim 1, wherein the at least one binder puller is $Cr_2O_3$.

3. The method according to claim 1, further comprising the step of heating the mining insert and media prior to the tumbling process and the tumbling process is performed on the heated mining insert.

4. The method according to claim 1, wherein the mining insert is kept heated during the tumbling process.

5. The method according to claim 1, wherein all or part of the heat is generated by friction between the mining insert and any media added in the tumbling process.

6. The method according to claim 1, wherein the tumbling process is a High Energy Tumbling process, wherein post tumbling a homogenous cemented carbide mining insert has been deformation hardened such that $\Delta HV3\% \geq 9.72 - 0.00543 * HV3_{bulk}$, wherein ΔHV3% is a percentage difference between a HV3 measurement at 0.3 mm from the surface compared to the HV3 measurement in the bulk.

7. The method according to claim 1, wherein after the mining insert has been subjected to the tumbling process at an elevated temperature, the mining insert is subjected to a second tumbling process at room temperature.

8. The method according to claim 7, wherein the second tumbling process is a high energy tumbling process.

* * * * *